US008867940B2

(12) United States Patent
Lee et al.

(10) Patent No.: US 8,867,940 B2
(45) Date of Patent: Oct. 21, 2014

(54) IMAGE FORMING APPARATUS AND METHOD OF CONTROLLING TRANSFER POWER THEREOF

(75) Inventors: Sun-woo Lee, Hwaseong-si (KR); Shinich Hisatomi, Suwon-si (KR); Byung-kyu Kim, Bucheon-si (KR)

(73) Assignee: Samsung Electronics Co., Ltd., Suwon (KR)

( * ) Notice: Subject to any disclaimer, the term of this patent is extended or adjusted under 35 U.S.C. 154(b) by 163 days.

(21) Appl. No.: 13/342,515

(22) Filed: Jan. 3, 2012

(65) Prior Publication Data

US 2012/0177391 A1 Jul. 12, 2012

(30) Foreign Application Priority Data

Jan. 6, 2011 (KR) ..... 10-2011-0001349
Aug. 1, 2011 (KR) ..... 10-2011-0076632

(51) Int. Cl.
*G03G 15/16* (2006.01)
*G03G 15/01* (2006.01)

(52) U.S. Cl.
CPC ..... *G03G 15/161* (2013.01); *G03G 15/1675* (2013.01); *G03G 15/0131* (2013.01); *G03G 15/1605* (2013.01); *G03G 2215/0119* (2013.01); *G03G 2215/0177* (2013.01)
USPC ..... 399/66

(58) Field of Classification Search
CPC ..... G03G 15/16
USPC ..... 399/45, 66
See application file for complete search history.

(56) References Cited

U.S. PATENT DOCUMENTS

| | | | | |
|---|---|---|---|---|
| 5,893,661 | A * | 4/1999 | Sakai et al. | 399/66 |
| 6,014,158 | A * | 1/2000 | Ziegelmuller et al. | 347/142 |
| 6,421,521 | B2 * | 7/2002 | Tanaka | 399/299 |
| 7,376,366 | B2 * | 5/2008 | Deguchi | 399/66 |
| 8,059,979 | B2 * | 11/2011 | Deguchi et al. | 399/66 |
| 2003/0228182 | A1 * | 12/2003 | Matsuduki | 399/384 |
| 2006/0029410 | A1 * | 2/2006 | Deguchi | 399/66 |
| 2007/0172244 | A1 * | 7/2007 | Lee et al. | 399/45 |
| 2008/0118281 | A1 * | 5/2008 | Saeki et al. | 399/308 |
| 2009/0080924 | A1 * | 3/2009 | Kojima | 399/66 |
| 2011/0085812 | A1 * | 4/2011 | Ishikawa | 399/66 |
| 2012/0308250 | A1 * | 12/2012 | Shimizu et al. | 399/66 |
| 2012/0315058 | A1 * | 12/2012 | Shimizu et al. | 399/66 |

FOREIGN PATENT DOCUMENTS

| | | |
|---|---|---|
| JP | 7-199687 | 8/1995 |
| JP | 2000-39782 | 2/2000 |
| JP | 3138085 | 12/2000 |
| JP | 3772523 | 2/2006 |

* cited by examiner

*Primary Examiner* — Clayton E Laballe
*Assistant Examiner* — Kevin Butler
(74) *Attorney, Agent, or Firm* — Staas & Halsey LLP

(57) ABSTRACT

An image forming apparatus including a transfer unit that transfers onto a transfer medium an image that is formed on a photosensitive medium; a power supply unit that provides a transfer power to the transfer unit; and a transfer power control unit that controls the transfer power that is provided to the transfer unit by the power supply unit. The transfer power control unit sets as a target voltage an output voltage of the power supply unit that is measured by supplying an initial transfer current to the transfer unit in a predetermined certain period before an image is transferred onto the transfer medium and controls the power supply unit to apply the set target voltage to the transfer unit while an image is being transferred onto the transfer medium.

20 Claims, 7 Drawing Sheets

IMAGE FORMING APPARATUS AND METHOD OF CONTROLLING TRANSFER POWER THEREOF

CROSS-REFERENCE TO RELATED APPLICATIONS

This application claims the benefit of Korean Patent Application No. 10-2011-0001349, filed on Jan. 6, 2011, and Korean Patent Application No. 10-2011-0076632, filed on Aug. 1, 2011, in the Korean Intellectual Property Office, the disclosures of which are incorporated herein in their entirety by reference.

BACKGROUND

1. Field

The present disclosure relates to an image forming apparatus that controls a transfer power for transferring an image formed on a photosensitive medium onto a transfer medium.

2. Description of the Related Art

In image forming apparatuses, a process of forming an image on a print medium is performed as follows. First, a photosensitive medium is exposed to light, thereby forming an electrostatic latent image thereon and a developing agent is then provided to the electrostatic latent image to develop the image. In other words, particles of the developing agent that are charged on a surface of the photosensitive medium are distributed according to the type of electrostatic latent image. Then, the image formed on the photosensitive medium is transferred onto a print medium. That is, the particles of the developing agent on the surface of the photosensitive medium are transferred onto the print medium. Lastly, the developing agent transferred onto the print medium is heated and pressured to be fixed thereon, thereby completing the formation of an image.

Among the above-described processes, the process of transferring the image formed on the photosensitive medium onto a print medium will now be described in more detail. The image formed on the photosensitive medium may be directly transferred onto a print medium on which an image is to be finally formed, e.g., paper or may be first transferred onto an intermediate transfer medium and then secondarily transferred onto a print medium from the intermediate transfer medium. Hereinafter, all the objects onto which an image is transferred are referred to as a transfer medium. When a voltage having a polarity that is opposite to that of charged particles of a developing agent on a surface of a photosensitive medium or an intermediate transfer medium is applied to a transfer medium, the particles of the developing agent are transferred onto the transfer medium by an electrostatic force. For example, if a positive voltage is applied to an opposite side of the photosensitive medium or the intermediate transfer medium with respect to the transfer medium when particles of a developing agent on a surface of a photosensitive medium or an intermediate transfer medium which are to form an image are negatively charged, the particles of the developing agent are transferred onto a surface of the transfer medium by an electrostatic force.

In this regard, the voltage may be applied to the opposite side of the transfer medium by a constant current (CC) method or constant voltage (CV) method. The former is a method whereby a CC is applied to a transfer member of a transfer roller positioned on an opposite side of a transfer medium and the latter is a method whereby a CV is applied thereto. In particular, when the CC method is used, an image forming apparatus is capable of appropriately responding to longitudinal changes such as a change in a load of a total system and a change in a resistance of a transfer medium, while it is difficult to respond to temporary changes such as a change in the density of images in consideration of characteristics in which a voltage changes according to a change in resistance. In contrast, when the CV method is used, a constant voltage is maintained in spite of frequent small changes in resistance and thus it is possible to appropriately respond to temporary resistance changes, while it is difficult to appropriately respond to longitudinal resistance changes.

SUMMARY

The present disclosure provides a method of controlling a transfer power of an image forming apparatus by using advantages of both a constant current method and a constant voltage method.

According to an aspect of the present disclosure, there is provided an image forming apparatus including: a transfer unit that transfers onto a transfer medium an image that is formed on a photosensitive medium; a power supply unit that provides a transfer power to the transfer unit; and a transfer power control unit that controls the transfer power that is provided to the transfer unit by the power supply unit, wherein the transfer power control unit sets as a target voltage an output voltage of the power supply unit that is measured by supplying an initial transfer current to the transfer unit in a predetermined certain period before an image is transferred onto the transfer medium and controls the power supply unit to apply the set target voltage to the transfer unit while an image is being transferred onto the transfer medium.

The transfer power control unit may calculate a system load of the image forming apparatus by using an output voltage of the power supply unit that is measured when the power supply unit supplies a constant current to the transfer unit and determines the initial transfer current based on the calculated system load.

The transfer power control unit may include a voltage measurement unit that measures an output voltage of the power supply unit; and a transfer current control unit for controlling a transfer current that is supplied to the transfer unit by the power supply unit according to the output voltage of the power supply unit that is measured by the voltage measurement unit.

The transfer current control unit may control the transfer current that is supplied to the transfer unit by the power supply unit so that the output voltage of the power supply unit is maintained as the target voltage while an image is being transferred onto the transfer medium.

The transfer current control unit may calculate a feedback correction rate by using an output voltage of the power supply unit that is measured while an image is being transferred onto the transfer medium and the target voltage, and, if the feedback correction rate is beyond a certain range, sets as a new transfer current a value obtained by adding an integer part of a value obtained by multiplying an existing transfer current by the feedback correction rate to the existing transfer current.

The transfer current control unit may determine as a feedback correction rate a result value obtained such that a value obtained by subtracting the output voltage of the power supply unit that is measured while the image is being transferred from the target voltage is divided by a value obtained by adding the target voltage and the output voltage of the power supply unit that is measured while the image is being transferred and the obtained value is then multiplied by a certain constant.

The transfer current control unit may control a degree of feedback control by adjusting the certain constant.

The transfer power control unit may measure an output voltage of the power supply unit a predetermined number of times while the power supply unit supplies the initial transfer current to the transfer unit in a predetermined certain period before an image is transferred onto the transfer medium and then sets an average of the measured output voltage values as a target voltage.

The transfer power control unit may set the target voltage in a period from the time after the transfer medium enters the transfer unit to the time before an image is transferred onto the transfer medium.

According to another aspect of the present disclosure, there is provided a method of controlling a transfer power of an image forming apparatus that includes a transfer unit that transfers an image onto a transfer medium and a power supply unit that provides a transfer power to the transfer unit, the method including: determining an initial transfer current; setting as a target voltage an output voltage of the power supply unit that is measured when the power supply unit supplies the determined initial transfer current to the transfer unit in a predetermined certain period before an image is transferred onto the transfer medium; and transferring an image onto the transfer medium by applying the target voltage to the transfer unit.

The determining may include calculating a system load of the image forming apparatus by using an output voltage of the power supply unit that is measured when the power supply unit supplies a constant current to the transfer unit and determines the initial transfer current based on the calculated system load.

The transferring may include measuring an output voltage of the power supply unit while an image is being transferred onto the transfer medium by supplying a transfer current to the transfer unit by the power supply unit; and controlling the transfer current that is supplied to the transfer unit by the power supply unit so that the output voltage of the power supply unit that is measured while the image is being transferred is maintained as the target voltage.

The controlling may include calculating a feedback correction rate by using the output voltage of the power supply unit that is measured while an image is being transferred and the target voltage, and, if the feedback correction rate is beyond a certain range, setting as a new transfer current a value obtained by adding an integer part of a value obtained by multiplying an existing transfer current by the feedback correction rate to the existing transfer current.

The calculating may include determining as a feedback correction rate a result value obtained such that a value obtained by subtracting the output voltage of the power supply unit that is measured while the image is being transferred from the target voltage is divided by a value obtained by adding the target voltage and the output voltage of the power supply unit that is measured while the image is being transferred and the obtained value is then multiplied by a certain constant.

The certain constant may be adjusted to control a degree of feedback control.

The setting may include measuring an output voltage of the power supply unit a predetermined number of times while the power supply unit supplies the initial transfer current to the transfer unit in a predetermined certain period before an image is transferred onto the transfer medium and then setting an average of the measured output voltage values as a target voltage.

The predetermined certain period may be a period from the time after the transfer medium enters the transfer unit to the time before an image is transferred onto the transfer medium.

Additional aspects and/or advantages will be set forth in part in the description which follows and, in part, will be apparent from the description, or may be learned by practice of the disclosure.

BRIEF DESCRIPTION OF THE DRAWINGS

The above and other features and advantages of the present disclosure will become more apparent by describing in detail exemplary embodiments thereof with reference to the attached drawings in which.

DETAILED DESCRIPTION

Exemplary embodiments of the present disclosure will now be described in more detail with reference to the accompanying drawings. For clarity of characteristics of the embodiments, a detailed description of features that are obvious to one of ordinary skill in the art to which the present disclosure pertains is not provided herein.

Figure 1:
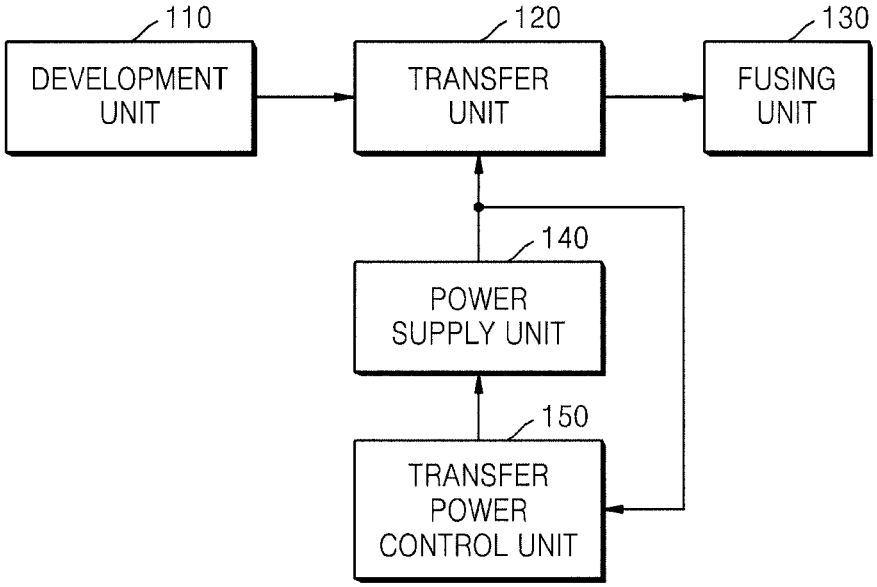
FIG. 1 is a block diagram illustrating an image forming apparatus according to an embodiment of the present disclosure.
Figure 2:
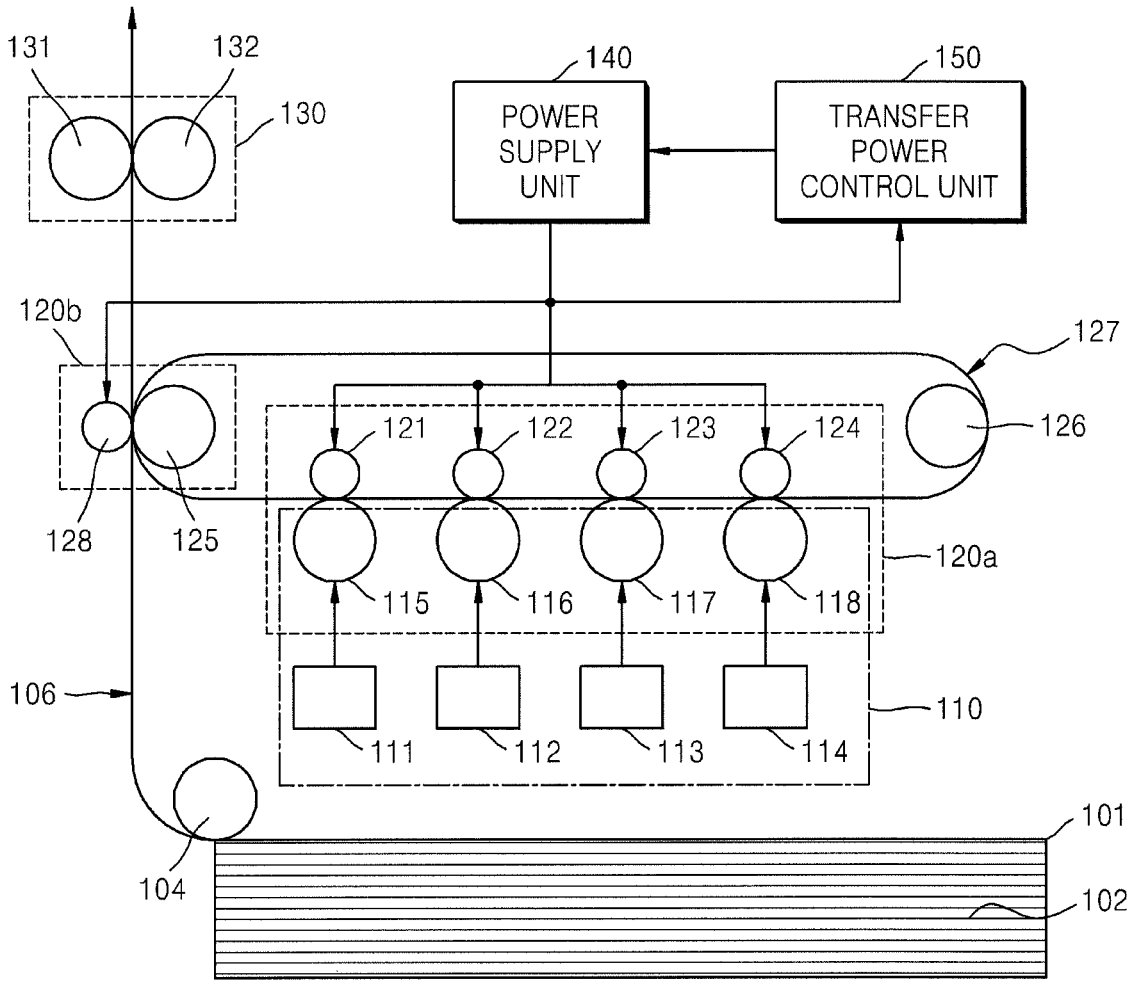
FIG. 2 is a diagram particularly illustrating a structure of an image forming apparatus according to an embodiment of the present disclosure.

FIG. 1 is a block diagram illustrating an image forming apparatus according to an embodiment of the present disclosure and FIG. 2 is a diagram particularly illustrating a structure of an image forming apparatus according to an embodiment of the present disclosure. Referring to FIGS. 1 and 2, the image forming apparatus includes a development unit 110, a transfer unit 120, a fusing unit 130, a power supply unit 140, and a transfer power control unit 150. The transfer unit 120 may include a first transfer unit 120*a* and a second transfer unit 120*b*.

When the image forming apparatus receives image data from the outside, the development unit 110 forms the image data into an image. In particular, when light exposure units 111 through 114 irradiate light onto photosensitive media 115 through 118, respectively, an electrostatic latent image is formed on each of the photosensitive media 115 through 118. Then, when a toner-containing developer is provided thereto, particles of the developer are charged on surfaces of the photosensitive media 115 through 118 and transferred thereto, thereby forming an image. Four light exposure units 111 to 114 and four photosensitive media 115 to 118 are illustrated in FIG. 2, which represents a general image forming apparatus for forming a color image which includes photosensitive media and light exposure units for four colors, respectively, i.e., cyan, magenta, yellow, and black. However, the number of the light exposure units and the photosensitive media is not limited to this example.

In the first transfer unit 120*a*, the images formed on the photosensitive media 115 through 118 are transferred onto an intermediate transfer belt 127. Cyan, magenta, yellow, and black images are sequentially transferred onto the intermediate transfer belt 127 that is circulated by intermediate transfer rollers 125 and 126, thereby completing the formation of a color image. The color image formed on the intermediate transfer belt 127 is then transferred onto a print medium 102 that is supplied by the second transfer unit 120*b*. In FIG. 2, an indirect transferring method in which, first, images are transferred onto the intermediate transfer belt 127 from the photosensitive media 115 through 118 and, second, transferred onto the print medium 102 from the intermediate transfer belt 127 is illustrated. However, a direct transferring method in which an image is directly transferred onto a print medium from a photosensitive medium may be used. In addition, objects onto which an image is transferred, e.g., the intermediate transfer belt 127 and the print medium 102 may be collectively referred to as transfer media.

The print medium 102 onto which the image is transferred is transferred to the fusing unit 130 after being removed from a tray 101 by a pick up roller 104 along a print medium transfer path 106 and heated and pressed by fusing rollers 131 and 132 of the fusing unit 130. As a result, the image is fused on the print medium 102, thereby completing the process of forming an image.

Hereinafter, the transferring process performed by the transfer unit 120 will be described in more detail. To transfer the images formed on the photosensitive media 115 through 118 onto the intermediate transfer belt 127, first transfer rollers 121 through 124 are provided with a transfer power by the power supply unit 140 to apply the transfer power to developer particles on surfaces of the photosensitive media 115 through 118. In other words, when a voltage having a polarity that is opposite to that of charged developer particles on the surfaces of the photosensitive media 115 through 118 is applied to each of the first transfer rollers 121 through 124, the developer particles on the surfaces of the photosensitive media 115 through 118 are transferred onto the intermediate transfer belt 127 by an electrostatic force. Similarly, in the second transfer unit 120*b*, when a second transfer roller 128 is provided with a transfer power by the power supply unit 140 to apply a voltage having polarity that is opposite to that of charged developer particles on a surface of the intermediate transfer belt 127 to the developer particles, the developer particles are transferred from the intermediate transfer belt 127 onto a surface of the print medium 102 that has been transferred through the print medium transfer path 106. In this regard, if the size of a transfer voltage applied to the charged developer particles is inappropriate, poor transfer or re-transfer may occur. If the size of the transfer voltage is less than that for an appropriate transferring process, all the developer particles are not transferred onto a transfer medium and some of them remain on a surface of a photosensitive medium, which is referred to as poor transfer. In contrast, if the size of the transfer voltage is greater than that for an appropriate transferring process, some of the developer particles that have been transferred onto a transfer medium are charged with the polarity of the transfer voltage, thereby being transferred back onto a surface of a photosensitive medium by attraction, which is referred to as re-transfer.

In this regard, the power supply unit 140 may provide the transfer power to the transfer unit 120 by using a constant current (CC) method or a constant voltage (CV) method.

The CC method is characterized in that when an image is transferred by the CC method, supplied current is maintained constant and thus a current density is bias-shifted by a change in resistance according to a change in the density of a transferred image. In other words, assuming that the same transfer current is supplied, the bias shift of the current density occurs between a low density image region and a high density image region and thus, even in the same solid pattern region, a current density in the high density image region is higher than that in the low density image region. In this regard, as a ratio of an area where an image pattern is formed to an entire area increases, the density of an image becomes high. In addition, the solid pattern region indicates a compact image pattern. Thus, if a transfer current is set in the low density image region, poor transfer may occur in the high density image region and, on the other hand, if a transfer current is set in the high density image region, re-transfer may occur in the low density image region. In detail, when the same transfer current is supplied to the low density image region and the high density image region, a higher transfer voltage is applied to the high density image region due to its high resistance as compared to the low density image region and thus a difference in the density of an image occurs between the low density image region and the high density image region. On the other hand, the CC method has an advantage in that the CC method appropriately responds to longitudinal changes such as a load of a system or the resistance of a transfer medium of an image forming apparatus.

The CV method is characterized in that in spite of a system load or a change in resistance of a transfer medium of an image forming apparatus, a transfer voltage is maintained constant and thus, if the system load or the resistance of the transfer medium of an image forming apparatus is reduced, there is a high possibility of re-transfer occurrence. On the other hand, if the system load or the resistance of the transfer medium of an image forming apparatus is increased, there is high possibility of poor transfer occurrence. On the other hand, the CV method has an advantage in that in spite of a change in the density of an image, a current density is maintained constant and thus a density difference according to a change in the density of an image does not occur.

The transfer power control unit 150 controls the power supply unit 140 to use both the CC and CV methods. In particular, the transfer power control unit 150 controls the power supply unit 140 to supply a current to the transfer unit 120 by the CC method and thus the transfer power control unit 150 measures a system load of an image forming apparatus and determines an appropriate initial transfer current based on the measured system load. In addition, the transfer power control unit 150 controls the power supply unit 140 to supply an initial transfer current as a CC to the transfer unit 120 in a certain period before an image is transferred and thus determines a measured output voltage of the transfer unit 120 as a target voltage. In this regard, the certain period before an image is transferred, in which a target voltage is determined, may be a certain period right before the transfer of an image onto the intermediate transfer belt 127 starts in the case of the first transferring process and a certain period before the transfer of an image onto the print medium 102 starts after a transfer medium, i.e., the print medium 102 enters the second transfer unit 120*b* in the case of the second transferring process. Subsequently, when the transfer of an image starts, the transfer power control unit 150 controls the power supply unit 140 to apply the determined target voltage as a CV. As described above, a target voltage is determined by the CC method before the transfer of an image by using the initial transfer current determined based on the system load of an image forming apparatus that is measured by the CC method and thus the image forming apparatus is capable of appropriately responding to a change in the surroundings or a change in resistance of a transfer medium. In addition, when an image is transferred, a target voltage is applied as a CV and thus a density difference may not occur in spite of a change in density of an image.

Figure 3A:
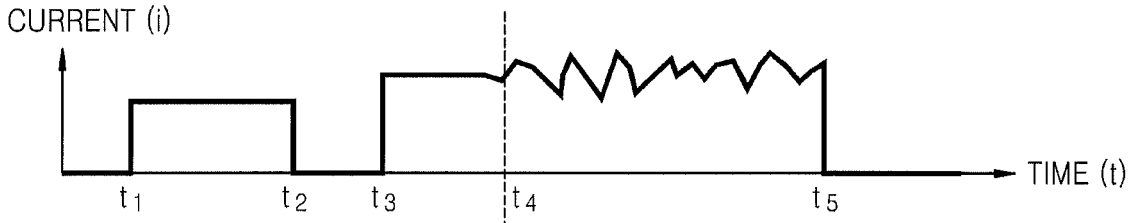
FIGS. 3A and 3B are graphs respectively illustrating a change in current with time and a change in voltage with time when a transfer power is controlled in an image forming apparatus, according to embodiments of the present disclosure.
Figure 3B:
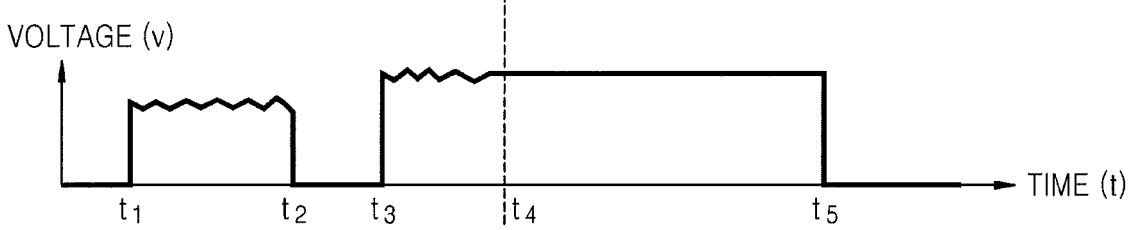

FIGS. 3A and 3B are graphs respectively illustrating a change in current with time and a change in voltage with time when a transfer power is controlled in an image forming apparatus, according to embodiments of the present disclosure. A method of controlling a transfer power in an image forming apparatus, according to another embodiment of the present disclosure, will now be described in more detail with reference to FIGS. 3A and 3B.

First, in a $t_1$ to $t_2$ period, the transfer power control unit 150 controls the power supply unit 140 to supply a current to the transfer unit 120 in a CC manner, measures an output voltage of the transfer unit 140, and calculates a system load of an image forming apparatus by using the measured output voltage of the transfer unit 140. As illustrated in FIG. 3B, the output voltage of the power supply unit 140 is inconstant in the $t_1$ to $t_2$ period and thus is measured several times, and an average of the measured output voltage values may be used. For example, the output voltage of the power supply unit 140 is measured 25 times in an interval of 4 ms and an average of the measured output voltage values is used to calculate a system load of an image forming apparatus. Based on calculated the system load of an image forming apparatus, an initial transfer current may be appropriately determined.

After the initial transfer current is determined, in a $t_3$ to $t_4$ period, the transfer power control unit 150 controls the power supply unit 140 to supply the determined initial transfer current to the transfer unit 120, measures an output voltage of the power supply unit 140 in this state, and determines the measured output voltage as a target voltage. The $t_3$ to $t_4$ period where a target voltage is determined may be a certain period right before an image is transferred onto an intermediate transfer belt in the case of a first transferring process in which an image is transferred onto an intermediate transfer belt from a photosensitive medium. The target voltage is determined by the CC method in a period right before the transfer of an image starts and thus an appropriate target voltage may be set according to a system environment right before the transfer of the image. In other words, even though a load of a system is changed by a change in a system environment in a $t_2$ to $t_3$ period, a target voltage is determined by the CC method in the $t_3$ to $t_4$ period and thus a target voltage that is adjusted for environmental changes may be determined.

Also, in a second transferring process in which an image is transferred onto a print medium from an intermediate transfer belt, the $t_3$ to $t_4$ period may be a period from the time after a print medium enters a transfer unit to the time before the transfer of an image onto the print medium starts. For example, the $t_3$ to $t_4$ period may be a period from the time when a top edge of a print medium, e.g., paper enters a transfer unit to the time when an image is initially transferred onto the paper. Thus, an appropriate target voltage that is adjusted for the resistance of the print medium may be determined. Like the case of measuring the system load, the output voltage of the power supply unit 140 is inconstant in the $t_3$ to $t_4$ period and thus it is measured several times and an average of the measured output voltage values may be determined as a target voltage. For example, the output voltage of the power supply unit 140 is measured five times in an interval of 4 ms and an average of the measured output voltage values may be determined as a target voltage. Subsequently, in a $t_4$ to $t_5$ period, the transfer power control unit 150 controls the power supply unit 140 to apply the determined target voltage to the transfer unit 120 as the CV to thus perform the transfer of an image.

In this regard, to use both the CC and CV methods, the power supply unit 140 includes a CC power supplier and a CV power supplier and the transfer power control unit 150 may control the power supply unit 140 to selectively use any one of them. Alternatively, the power supply unit 140 includes only a CC power supplier and the transfer power control unit 150 controls a transfer current, thereby implementing a CV method. In this case, the transfer power control unit 150 includes firmware for controlling a transfer current and the control of the transfer current may be performed by the firmware. An exemplary embodiment of the case where the power supply unit 140 includes only a CC power supplier and firmware controls a transfer current to thus implement a CV method will now be described in more detail with reference to FIG. 4.

Figure 4:
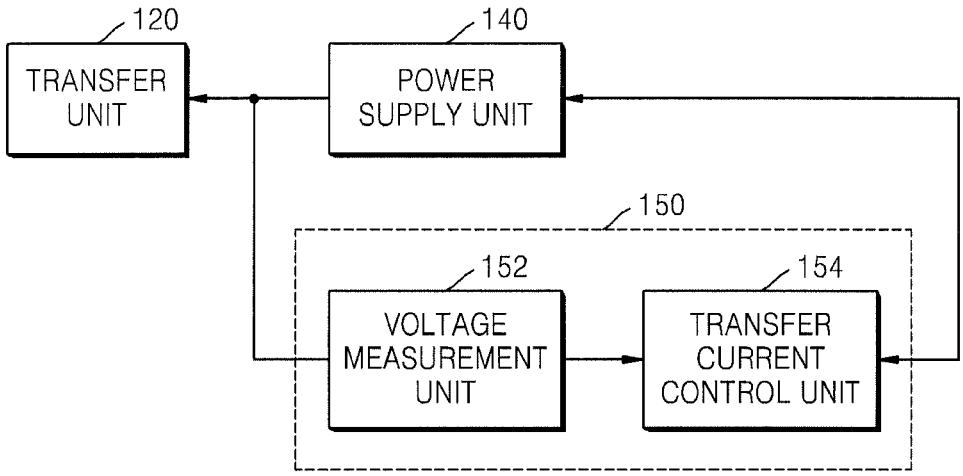
FIG. 4 is a block diagram particularly illustrating a transfer power control unit of an image forming apparatus, according to an embodiment of the present disclosure.

FIG. 4 is a block diagram particularly illustrating a transfer power control unit 150 of an image forming apparatus, according to an embodiment of the present disclosure. Referring to FIG. 4, the transfer power control unit 150 includes a voltage measurement unit 152 and a transfer current control unit 154. A method of determining an initial transfer current and a target voltage has already been described above with reference to FIGS. 1 through 3 and thus a detailed description thereof is not provided herein. Hereinafter, a method of applying a target voltage as a CV by controlling a transfer current will be described in detail.

The voltage measurement unit 152 may measure an output voltage of the power supply unit 140 of an image forming apparatus. The transfer current control unit 154 may perform feedback control on the output voltage of the power supply unit 140 to be maintained as a target voltage while an image is being transferred. When the transfer of an image onto a transfer medium starts, the voltage measurement unit 152 measures the output voltage of the power supply unit 140 in a period where an image is transferred and the transfer current control unit 154 performs feedback control by using the measured output voltage. In this regard, the output voltage of the power supply unit 140 varies with time and thus it is measured a certain number of times and an average of the measured output voltage values may be used. For example, the output voltage of the power supply unit 140 may be measured ten times in an interval of 4 ms and an average thereof may be used. When the output voltage of the power supply unit 140 is measured, a feedback correction rate for feedback control may be calculated by Equation 1:

$$K = \frac{V_t - V}{V_t + V} \times C. \qquad \text{Equation (1)}$$

In Equation 1, $V_t$ is a target voltage, V is an output voltage of the power supply unit 140 that is measured while an image is being transferred, C is a certain constant, and K is a feedback correction rate. C is a constant for determining a degree of feedback control. If the C value is high, the transfer power control unit 150 sensitively responds to even a small change in the output voltage of power supply unit 140 and thus the degree of feedback control increases. On the other hand, if the C value is low, the degree of feedback control decreases. For example, the C value may be set to be 1.5.

After the feedback correction rate is calculated, it is determined whether the feedback correction rate is within a certain range. If it is beyond the certain range, feedback control is performed on the transfer current. For example, if the calculated feedback correction rate is less than 0.03, an existing transfer current is maintained the same and, on the other hand, if the calculated feedback correction rate is 0.03 or greater, the transfer current control unit 154 controls the power supply unit 140 to supply a new transfer current that is calculated by Equation 2 below to the transfer unit 120. In this regard, a constant for comparison with the feedback correction rate may be values other than 0.03 according to a desired degree of feedback control. If the degree of feedback control is set high, a smaller value than 0.03 may be used. If the constant value is too low, however, voltage swing may occur due to excessive feedback. On the other hand, if the degree of feedback control is set low, a greater value than 0.03 may be used. If the constant value is too high, response deficiency may occur due to feedback deficiency.

$$C_{new}=C_{current}+Int(C_{current}\times K) \quad \text{Equation(2).}$$

In Equation 2, $C_{current}$ is a transfer current that is being supplied, K is feedback correction rate, and $C_{new}$ is a new transfer current that is calculated by feedback control. In other words, a result value obtained by adding an integer part of a value obtained by multiplying the existing transfer current by the feedback correction rate to the existing transfer current may be set as a new transfer current.

The transfer current control unit 154 calculates a feedback correction rate by using the output voltage of the power supply unit 140 that is measured by the voltage measurement unit 152 while an image is being transferred and a target voltage, and, if the calculated feedback correction rate is beyond a certain range, the transfer current control unit 154 controls a transfer current so as to allow the output voltage of the power supply unit 140 to be maintained within a certain range from the target voltage. In other words, the target voltage may be applied as a CV through the feedback control of the transfer current. Thus, in the case in which the power supply unit 140 includes only a CC power supplier and implements a CV method by firmware, manufacturing costs are lower and the size of the manufactured products is relatively small as compared to the case in which the power supply unit further includes a CV power supplier.

FIGS. 5 through 8 are flowcharts for explaining a method of controlling a transfer power, according to embodiments of the present disclosure. The controlling method of the transfer power will now be described in more detail with reference to FIGS. 5 through 8.

Figure 5:
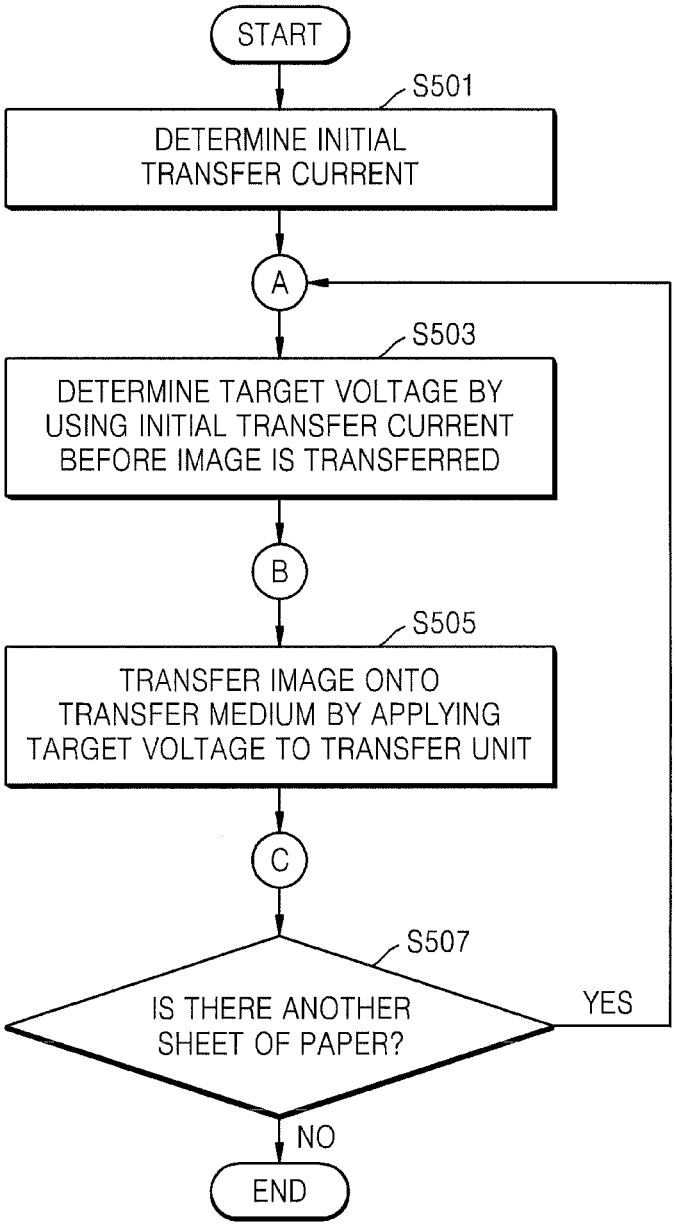
FIGS. 5 through 8 are flowcharts for explaining a method of controlling a transfer power, according to embodiments of the present disclosure.
Figure 6:
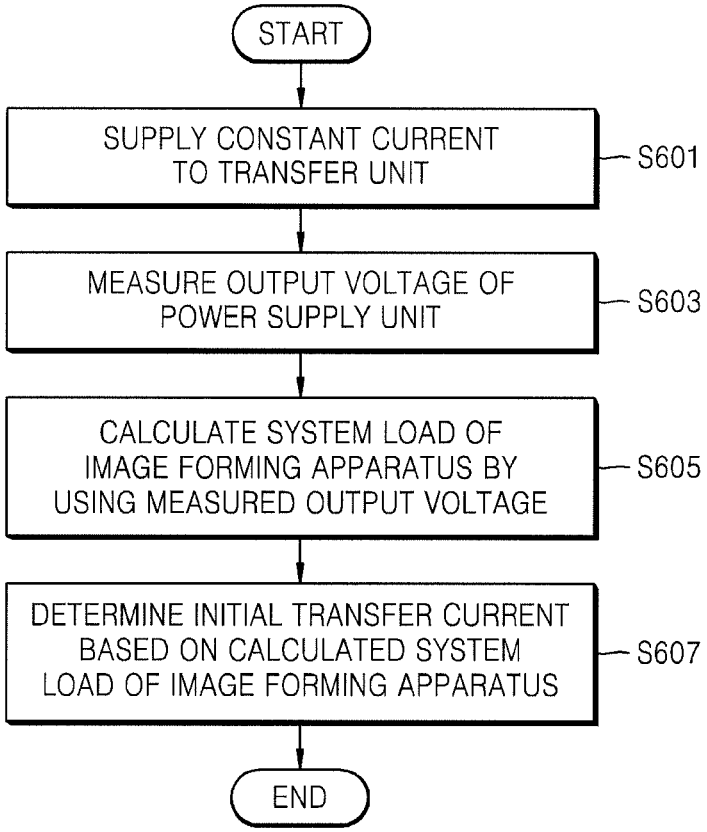

Referring to FIG. 5, first, a transfer power control unit determines an initial transfer current (operation S501). In FIG. 6, operation S501 is particularly illustrated. Referring to FIG. 6, a power supply unit supplies a current to a transfer unit in a CC manner (operation S601). Then, an output voltage of the power supply unit is measured in this state (operation S603). A system load of an image forming apparatus is calculated using the measured output voltage (operation S605). In this regard, the output voltage of the power supply unit is inconstant in a certain period and thus it is measured several times and an average thereof may be used. For example, the output voltage of the power supply unit is measured 25 times in an interval of 4 ms and an average thereof may be used to calculate the system load of the image forming apparatus. When the system load is calculated, an appropriate initial transfer current is determined based thereon (operation S607).

Referring back to FIG. 5, when the initial transfer current is determined in operation S501, the method proceeds to operation S503. In operation S503, the power supply unit supplies an initial transfer current in a predetermined certain period before an image is transferred to a transfer unit and determines an output voltage of the power supply unit that is measured in this state as a target voltage. The target voltage is applied to the transfer unit as a CV to transfer an image onto a transfer medium (operation S505). In this regard, the application of the target voltage to the transfer unit as a CV is performed as follows. For example, if the power supply unit includes a CV power supplier, the CV power supplier may be used or if the power supply unit includes only a CC power supplier, the output voltage of the power supply unit may be maintained as a target voltage through feedback control of a transfer current. An exemplary embodiment of the case where the target voltage is applied through the feedback control of the transfer current will be described below in more detail with reference to FIG. 7. Lastly, if there is another sheet of paper after the transfer of an image onto a sheet of paper is terminated, operations S503 and S505 are repeatedly performed (operation S507).

Figure 7:
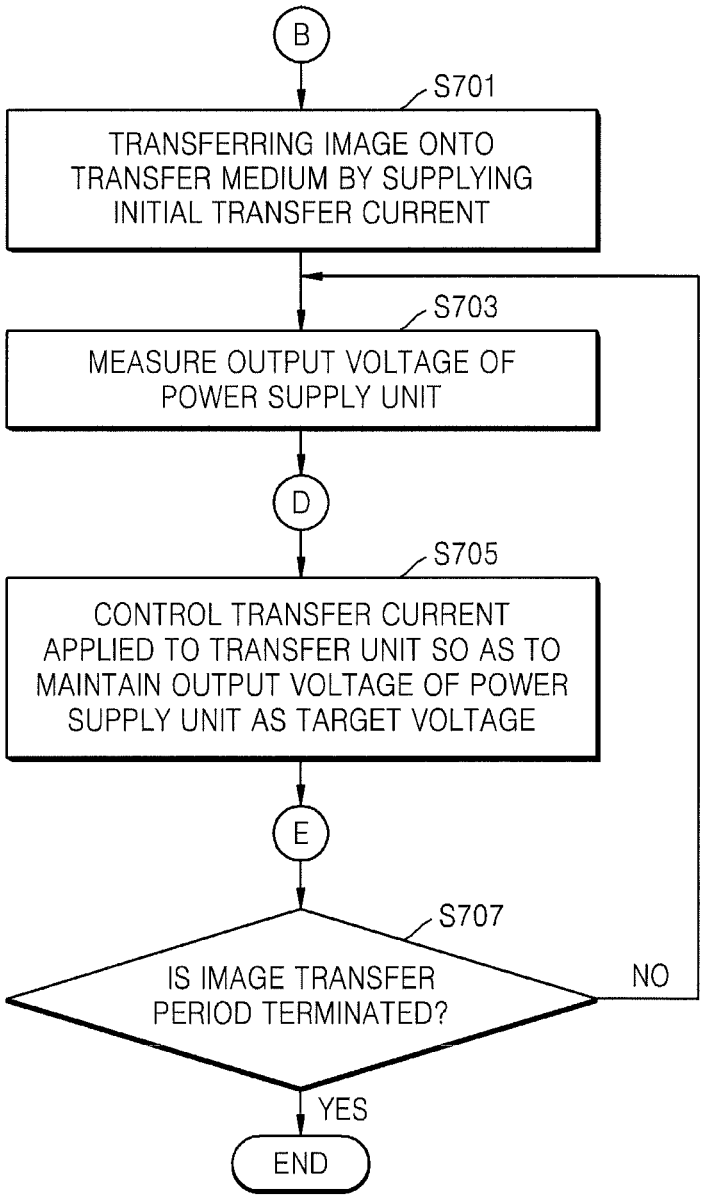
Figure 8:
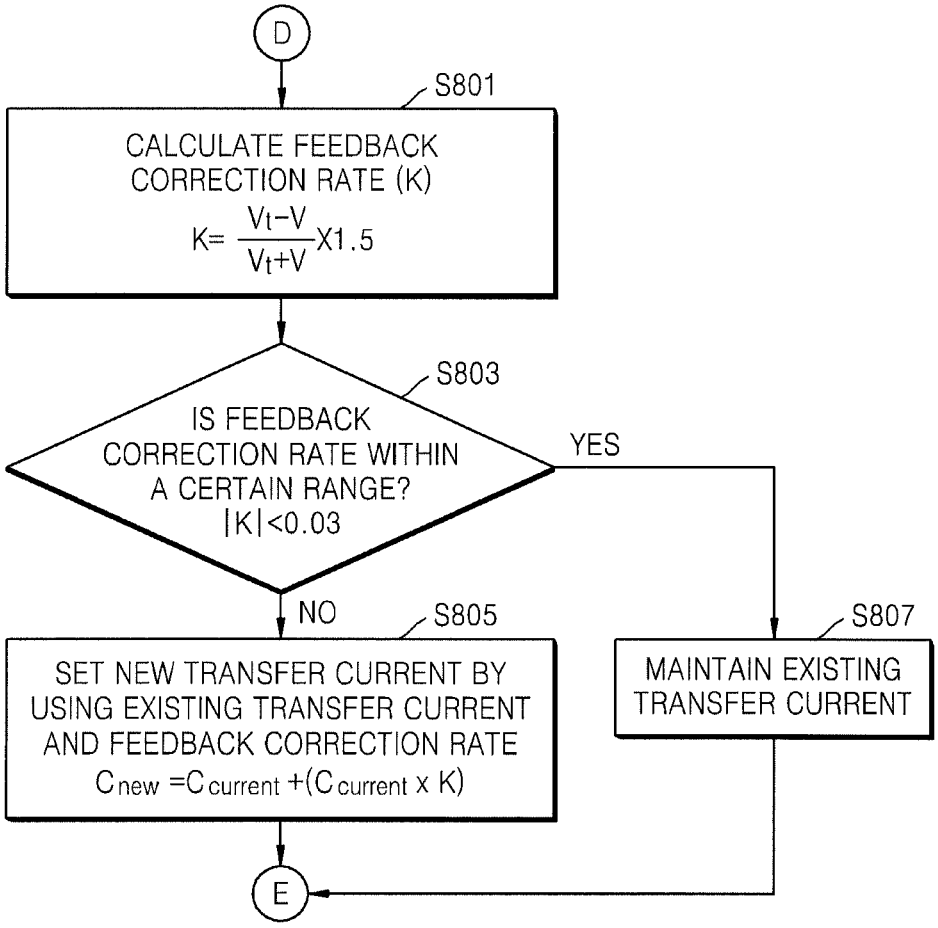

FIG. 7 is a flowchart particularly illustrating operation S505 in which the power supply unit includes only a CC power supplier, and a transfer current of the power supply unit is controlled by firmware and thus the output voltage of the power supply unit is maintained as a target voltage. Referring to FIG. 7, the power supply unit supplies an initial transfer current to the transfer unit, thereby starting the transfer of an image (operation S701). An output voltage of the power supply unit is measured during the transfer of the image (operation S703). In this regard, the output voltage of the power supply unit varies with time and thus it is measured several times and an average thereof may be used. For example, the output voltage of the power supply unit is measured 10 times in an interval of 4 ms and an average thereof may be used. If the measured output voltage of the power supply unit is beyond a certain range, the transfer current supplied by the power supply unit is controlled to maintain the output voltage as a target voltage (operation S705). FIG. 5 is a flowchart particularly illustrating operation S705. Referring to FIG. 8, a feedback correction rate is calculated by Equation 1 above (operation S801). It is determined whether the feedback correction rate is beyond a certain range (operation S803). In this embodiment, it is determined whether the feedback correction rate is 0.03 or greater. If the feedback correction rate is less than 0.03, the method proceeds to operation S807 and the existing transfer current is maintained the same. If the feedback correction rate is 0.03 or greater, however, the method proceeds to operation S805 and a new transfer current is set by Equation 2 above. In this regard, a constant for comparison with the feedback correction rate may be values other than 0.03 according to a desired degree of feedback control. If the degree of feedback control is set high, a smaller value than 0.03 may be used. If the constant value is too low, however, voltage swing may occur due to excessive feedback. On the other hand, if the degree of feedback control is set low, a greater value than 0.03 may be used. If the constant value is too high, response deficiency may occur due to feedback deficiency.

If operation S705 is terminated, it is determined whether an image transfer period is terminated (operation S707). If the image transfer period is terminated, the method proceeds to operation S507 of FIG. 5 and, if the image transfer period is not terminated, operations S703 and S705 are repeatedly performed.

As described above, according to the one or more embodiments of the present disclosure, a transfer power is applied to a transfer unit by using a CC method in a predetermined certain period before an image is transferred onto a transfer medium, whereby a target voltage is set, and, while the image is being transferred onto the transfer medium, a target voltage is applied to the transfer unit by using a CV method. Thus, an image forming apparatus may appropriately respond to both longitudinal changes such as a change in a system load or the resistance of a transfer medium of the image forming apparatus and temporary changes such as a change in the density of a transferred image. In other words, the image forming apparatus may have the advantages of a CC method and a CV method.

In addition, a CC power supplier is controlled by firmware, whereby an output voltage of the power supplier is maintained as a target voltage. Therefore, even though the image forming apparatus does not include a CV power supplier, it may implement a CV method.

While the present disclosure has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An image forming apparatus comprising:

a transfer unit that transfers onto a transfer medium an image that is formed on a photosensitive medium;

a power supply unit that provides a transfer power to the transfer unit; and a transfer power control unit that controls the transfer power that is provided to the transfer unit by the power supply unit, wherein the transfer power control unit sets as a target voltage an output voltage of the power supply unit that is measured by supplying an initial transfer current to the transfer unit in a predetermined certain period before an image is transferred onto the transfer medium and controls the power supply unit to apply the set target voltage to the transfer unit by controlling a transfer current that is supplied to the transfer unit from the power supply unit while an image is being transferred onto the transfer medium based on a value of a feedback correction rate.

2. The image forming apparatus of claim 1, wherein the transfer power control unit calculates a system load of the image forming apparatus by using an output voltage of the power supply unit that is measured when the power supply unit supplies a constant current to the transfer unit and determines the initial transfer current based on the calculated system load.

3. The image forming apparatus of claim 1, wherein the transfer power control unit comprises:

a voltage measurement unit that measures an output voltage of the power supply unit, and a transfer current control unit that controls a transfer current that is supplied to the transfer unit by the power supply unit according to the output voltage of the power supply unit that is measured by the voltage measurement unit.

4. The image forming apparatus of claim 3, wherein the transfer current control unit controls the transfer current that is supplied to the transfer unit by the power supply unit so that the output voltage of the power supply unit is maintained as the target voltage while an image is being transferred onto the transfer medium.

5. The image forming apparatus of claim 4, wherein the transfer current control unit calculates the feedback correction rate by using an output voltage of the power supply unit that is measured while an image is being transferred onto the transfer medium and the target voltage, and, if the feedback correction rate is beyond a certain range, sets as a new transfer current a value obtained by adding an integer part of a value obtained by multiplying an existing transfer current by the feedback correction rate to the existing transfer current.

6. The image forming apparatus of claim 5, wherein the transfer current control unit determines as the feedback correction rate a result value obtained such that a value obtained by subtracting the output voltage of the power supply unit that is measured while the image is being transferred from the target voltage is divided by a value obtained by adding the target voltage and the output voltage of the power supply unit that is measured while the image is being transferred and the obtained value is then multiplied by a certain constant.

7. The image forming apparatus of claim 6, wherein the transfer current control unit controls a degree of feedback control by adjusting the certain constant.

8. An image forming apparatus comprising:

a transfer unit that transfers onto a transfer medium an image that is formed on a photosensitive medium;

a power supply unit that provides a transfer power to the transfer unit; and a transfer power control unit that controls the transfer power that is provided to the transfer unit by the power supply unit, wherein the transfer power control unit sets as a target voltage an output voltage of the power supply unit that is measured by supplying an initial transfer current to the transfer unit in a predetermined certain period before an image is transferred onto the transfer medium and controls the power supply unit to apply the set target voltage to the transfer unit while an image is being transferred onto the transfer medium, wherein the transfer power control unit measures an output voltage of the power supply unit a predetermined number of times while the power supply unit supplies the initial transfer current to the transfer unit in a predetermined certain period before an image is transferred onto the transfer medium and then sets an average of the measured output voltage values as a target voltage.

9. An image forming apparatus comprising:

a transfer unit that transfers onto a transfer medium an image that is formed on a photosensitive medium;

a power supply unit that provides a transfer power to the transfer unit; and a transfer power control unit that controls the transfer power that is provided to the transfer unit by the power supply unit, wherein the transfer power control unit sets as a target voltage an output voltage of the power supply unit that is measured by supplying an initial transfer current to the transfer unit in a predetermined certain period before an image is transferred onto the transfer medium and controls the power supply unit to apply the set target voltage to the transfer unit while an image is being transferred onto the transfer medium, wherein the transfer power control unit sets the target voltage in a period from the time after the transfer medium enters the transfer unit to the time before an image is transferred onto the transfer medium.

10. A method of controlling a transfer power of an image forming apparatus that comprises a transfer unit that transfers an image onto a transfer medium and a power supply unit that provides a transfer power to the transfer unit, the method comprising:

determining an initial transfer current;

setting as a target voltage an output voltage of the power supply unit that is measured when the power supply unit supplies the determined initial transfer current to the transfer unit in a predetermined certain period before an image is transferred onto the transfer medium; and transferring an image onto the transfer medium by applying the target voltage to the transfer unit by controlling transfer current that is supplied to the transfer unit based on a value of a feedback correction rate.

11. The method of claim 10, wherein the determining comprises calculating a system load of the image forming apparatus by using an output voltage of the power supply unit that is measured when the power supply unit supplies a constant current to the transfer unit and determines the initial transfer current based on the calculated system load.

12. The method of claim 10, wherein the transferring comprises:

measuring an output voltage of the power supply unit while an image is being transferred onto the transfer medium by supplying a transfer current to the transfer unit by the power supply unit, and controlling the transfer current that is supplied to the transfer unit by the power supply unit so that the output voltage of the power supply unit that is measured while the image is being transferred is maintained as the target voltage.

13. The method of claim 12, wherein the controlling comprises calculating the feedback correction rate by using the output voltage of the power supply unit that is measured while an image is being transferred and the target voltage, and, if the feedback correction rate is beyond a certain range, setting as a new transfer current a value obtained by adding an integer part of a value obtained by multiplying an existing transfer current by the feedback correction rate to the existing transfer current.

14. The method of claim 13, wherein the calculating comprises determining as the feedback correction rate a result value obtained such that a value obtained by subtracting the output voltage of the power supply unit that is measured while the image is being transferred from the target voltage is divided by a value obtained by adding the target voltage and the output voltage of the power supply unit that is measured while the image is being transferred and the obtained value is then multiplied by a certain constant.

15. The method of claim 14, wherein the certain constant is adjusted to control a degree of feedback control.

16. A method of controlling a transfer power of an image forming apparatus that comprises a transfer unit that transfers an image onto a transfer medium and a power supply unit that provides a transfer power to the transfer unit, the method comprising:

determining an initial transfer current;

setting as a target voltage an output voltage of the power supply unit that is measured when the power supply unit supplies the determined initial transfer current to the transfer unit in a predetermined certain period before an image is transferred onto the transfer medium; and transferring an image onto the transfer medium by applying the target voltage to the transfer unit, wherein the setting comprises measuring an output voltage of the power supply unit a predetermined number of times while the power supply unit supplies the initial transfer current to the transfer unit in a predetermined certain period before an image is transferred onto the transfer medium and then setting an average of the measured output voltage values as a target voltage.

17. A method of controlling a transfer power of an image forming apparatus that comprises a transfer unit that transfers an image onto a transfer medium and a power supply unit that provides a transfer power to the transfer unit, the method comprising:

determining an initial transfer current setting as a target voltage an output voltage of the power supply unit that is measured when the power supply unit supplies the determined initial transfer current to the transfer unit in a predetermined certain period before an image is transferred onto the transfer medium; and transferring an image onto the transfer medium by applying the target voltage to the transfer unit, wherein the predetermined certain period is a period from the time after the transfer medium enters the transfer unit to the time before an image is transferred onto the transfer medium.

18. A non-transitory computer-readable recording medium that records a program for executing a method on a computer of controlling a transfer power of an image forming apparatus that comprises a transfer unit that transfers an image onto a transfer medium and a power supply unit that provides a transfer power to the transfer unit, the method comprising:

determining an initial transfer current;

setting as a target voltage an output voltage of the power supply unit that is measured when the power supply unit supplies the determined initial transfer current to the transfer unit in a predetermined certain period before an image is transferred onto the transfer medium; and transferring an image onto the transfer medium by applying the target voltage to the transfer unit by controlling transfer current that is supplied to the transfer unit based on a value of a feedback correction rate.

19. A method of controlling a transfer power of an image forming apparatus having a transfer unit that transfers an image onto a transfer medium and a power supply unit that provides a transfer power to the transfer unit, the method comprising:

applying transfer power to the transfer unit using a constant current method for a predetermined certain period before the image is transferred onto the transfer medium, whereby a target voltage is set; and while the image is being transferred onto the transfer medium, applying a target voltage to the transfer unit using a constant voltage method by controlling transfer current that is supplied to the transfer unit based on a value of a feedback correction rate.

20. The method of claim 19, wherein the constant voltage method is performed by using a constant voltage power supplier or using a constant current power supplier which is controlled by firmware.

* * * * *